US005156091A

United States Patent [19]

Bätz

[11] Patent Number: 5,156,091

[45] Date of Patent: Oct. 20, 1992

[54] AXIALLY ADJUSTABLE REGISTER PIN ASSEMBLY

[75] Inventor: Peter W. Bätz, Zellingen, Fed. Rep. of Germany

[73] Assignee: Koenig & Bauer Aktiengesellschaft, Würzburg, Fed. Rep. of Germany

[21] Appl. No.: 802,399

[22] Filed: Dec. 4, 1991

[30] Foreign Application Priority Data

Dec. 6, 1990 [DE] Fed. Rep. of Germany ..... 4038920

[51] Int. Cl.[5] ..... B41F 27/06; B41F 27/12; B41L 29/20

[52] U.S. Cl. ..... 101/415.1

[58] Field of Search ..... 101/415.1, 378, 408–412, 101/246

[56] References Cited

U.S. PATENT DOCUMENTS 4,510,868 4/1985 Fischer ..... 101/415.1
4,748,911 6/1988 Kobler ..... 101/415.1
5,016,531 5/1991 Schroeder ..... 101/415.1

FOREIGN PATENT DOCUMENTS 2045953 10/1981 Fed. Rep. of Germany .
3545297 7/1987 Fed. Rep. of Germany .

*Primary Examiner*—J. Reed Fisher
*Attorney, Agent, or Firm*—Jones, Tullar & Cooper

[57] ABSTRACT

An axially adjustable register pin assembly for axially shifting a printing plate on a plate cylinder of a rotary printing press is positioned on an insertion bar that is received in a cylinder. The shiftable register pin assembly utilizes an eccentric adjusting bolt and spaced fastening screws positioned in elongated fastening holes to effect axial shifting of the register pin.

3 Claims, 3 Drawing Sheets

AXIALLY ADJUSTABLE REGISTER PIN ASSEMBLY

FIELD OF THE INVENTION

The present invention is directed generally to an axially adjustable register pin. More particularly, the present invention is directed to an axially adjustable register pin for a plate cylinder of a rotary printing press. Most specifically, the present invention is directed to an axially adjustable register pin assembly including an eccentric holding bolt for changing the position of the axially adjustable register pin. The register pin has an upper register portion and a lower fastening portion. This lower fastening portion is receivable in an axially extending slot in an insertion bar that is received in a cylinder gap in the periphery of the plate cylinder. A pair of fastening screws pass through elongated slots in the fastening portion of the register pin. An eccentric bolt is received in an elongated hole that is offset to the elongated slots. Rotation of the eccentric bolt effects an axial shifting of the register pin in the recess in the insertion bar.

DESCRIPTION OF THE PRIOR ART

Many printing operations are accomplished by passing an elongated paper web through a series of rotary printing units which together form a rotary press assembly. This is frequently the situation when the paper web being printed is to have multiple colors or types of printing steps performed on it. In such rotary presses that have several axially arranged printing units, it is often the case that the printed paper web changes its width from printing unit to printing unit. Such changes in width are often caused by absorption of dampening fluid during the printing operation and by other changes in the state of the paper. These width variations in the paper web, can cause printing errors and register errors.

Various attempts have been made to provide axially shiftable register pins so that the position of the printing plate on the surface of the plate cylinder can be shifted axially to compensate for paper web width changes. In one prior device that is set forth in German published unexamined patent application No. 3,545,297 the register pins for two printing plates that are arranged adjacent each other on a plate cylinder can be axially shifted by means of a side register adjusting device. Each of the register pins is linked to each other by means of an adjusting bar or an adjusting tubular shaft by means of threads having different pitches. This adjusting bar or shaft is rotatable by an adjusting screw.

In a device of the type set forth in this prior arrangement, the register pins for the two printing plates which are positioned adjacent each other always have to be adjusted simultaneously and both at the same rate. It is not possible to attain better printing quality by effecting the adjustment of only one of the register pins with a device of this type. A connecting bar between the register pin and the adjusting screw has a substantial length which is required to reach the adjustable register pins that are located near the middle of the cylinder. This long connecting bar requires suitable guide bushings and supports so that register accuracy does not diminish with increasing distance from the adjusting screw. The resultant adjusting assembly is quite complicated in construction and requires a significant amount of space.

It thus is costly to manufacture and increases the size and complexity of the plate cylinder.

An alternative assembly that is intended for use in plate registry is shown in German published unexamined patent application No. 2,045,953. This device provides a stop in the plate cylinder gap. This stop is positioned at one end of the gap and is in the form of a clamping bushing which engages one side or end of the printing plate. Since this device contacts only one side edge of the printing plate, the plate is secured against lateral movement in only one direction. With this type of assembly, it is not possible to facilitate a lateral positioning of both sides of the printing plate at the same time. In this prior device, it is also not possible to use the stop as a register pin. The stop, since it is in the form of a clamping bushing changes its external shape during clamping. Thus a measurement, taken before clamping of the bushing, will be changed by the clamping itself.

It will thus be seen that a need exists for an axially adjustable register pin assembly that overcomes the limitations of the prior devices. The axially adjustable register pin assembly in accordance with the present invention provides such a device and is a substantial improvement over the prior devices.

SUMMARY OF THE INVENTION

It is an object of the present invention to provide an axially adjustable register pin.

Another object of the present invention is to provide an axially adjustable register pin for a plate cylinder of a rotary press.

A further object of the present invention is to provide an axially adjustable register pin for a plate cylinder in which the register pin can be fixed in place separately.

Yet another object of the present invention is to provide an axially adjustable register pin assembly that is positionably secured in a cylinder gap of a plate cylinder.

Still a further object of the present invention is to provide an axially adjustable register pin that is securable by a pair of spaced fastening screws.

Even yet another object of the present invention is to provide an axially adjustable register pin that is adjustable along an insertion bar carried in the cylinder gap of a plate cylinder.

As will be discussed in greater detail in the description of the preferred embodiment which is presented subsequently, the axially adjustable register pin in accordance with the present invention includes a register portion and a fastening portion. The register portion has opposing register ends that are received in register slots in the leading and trailing ends of a printing plate that is clamped to the surface of the plate cylinder. The fastening portion of the register pin includes two outwardly directed fastening ends. The two fastening ends of the fastening portion are received for axial sliding motion in the recess in the insertion bar. Each end of the fastening portion has an elongated slot whose long axis is coincident with the axis of rotation of the plate cylinder. A fastening screw is received in each elongated slot and is threaded into an underlying threaded bore in the insertion bar. An eccentric bolt head is provided on an adjusting bolt that is also received in a threaded bore hole in the insertion bar. The eccentric bolt head is received in an elongated slot that is oriented generally at 90° to the two elongated fastening screw receiving slots. The receiving pin can be moved axially along the insertion bar by loosening the fastening screws and rotating the eccentric adjusting bolt.

A significant advantage of the axially adjustable register pin assembly of the present invention is that each printing plate can be laterally repositioned individually without shifting or displacing the entire printing plate device. The axially adjustable register pin of the present invention does not utilize lengthy screws or adjusting bars and is not expensive to manufacture or maintain. It can be used with plate cylinders having bearer rings as well as plate cylinders without bearer rings.

The axially adjustable register pin assembly in accordance with the present invention overcomes the limitations of the prior devices and is a significant advance in the art.

BRIEF DESCRIPTION OF THE DRAWINGS

While the novel features of the axially adjustable register pin assembly in accordance with the present invention are set forth with particularity in the appended claims, a full and complete understanding of the invention may be had by referring to the detailed description of the preferred embodiment which is presented subsequently, and as illustrated in the accompanying drawings in which:

DESCRIPTION OF THE PREFERRED EMBODIMENT

Figure 1:
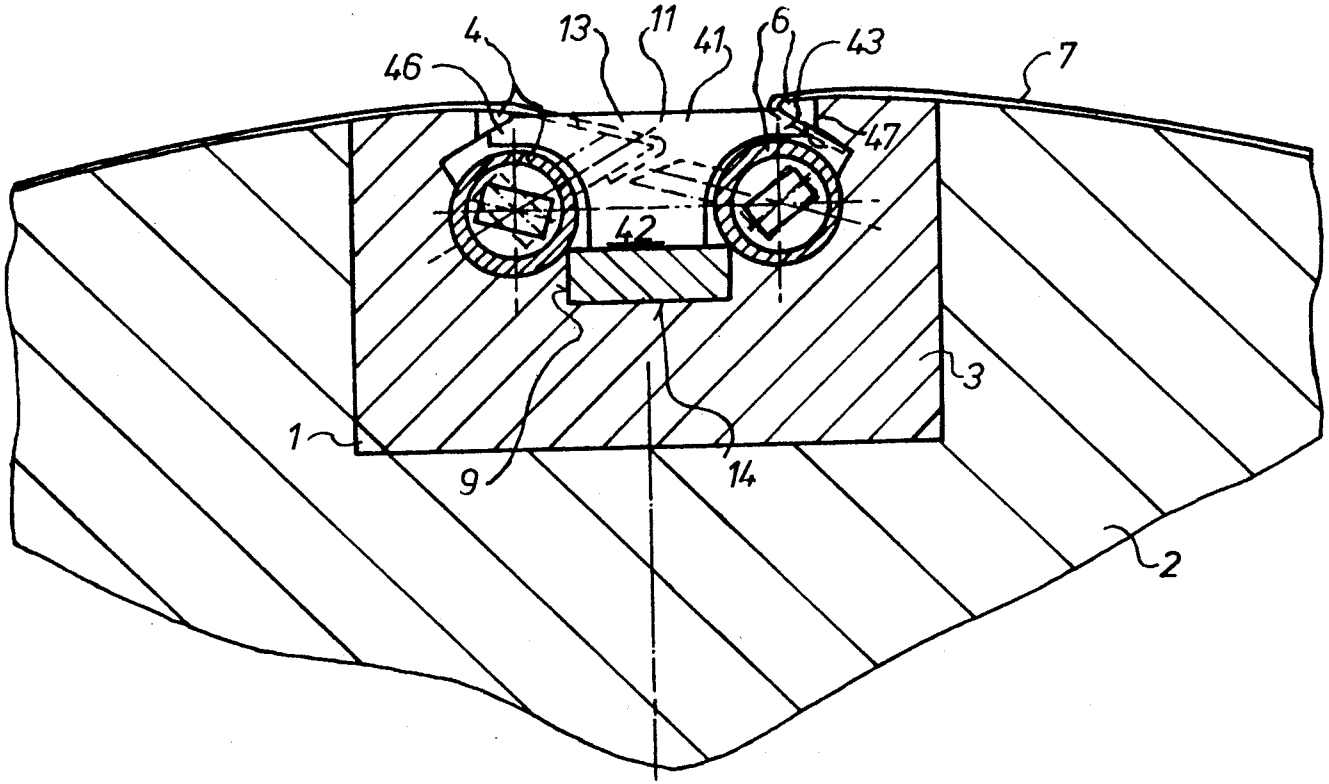
FIG. 1 is cross-sectional side elevation view of an axially adjustable register pin assembly in accordance with the present invention positioned for use in a cylinder gap of a plate cylinder.

Referring initially to FIG. 1, there may be seen a preferred embodiment of an axially adjustable register pin assembly in accordance with the present invention. A plate cylinder 2 of a rotary printing press is provided with a generally conventional, axially extending cylinder gap 1 at its periphery. An insertion bar 3 is securely positioned in the cylinder gap 1 and carries a pair of generally parallel, axially extending and circumferentially spaced printing plate end clamping and fixing devices 4 and 6. These plate end clamping devices 4 and 6 are rotatable in either direction in a generally known manner to clamp and fix the leading and trailing ends of a printing plate 7 which is to be secured to the outer peripheral surface of the plate cylinder 2. The insertion bar 3 can be removed from the cylinder gap 1 and is held in place by suitable means that are not specifically shown.

One or more printing plates 7 may be attached to the insertion bar 3 and held in place on the plate cylinder 2. One or more recesses or openings 9 are provided in the insertion bar 3. Each recess is structured to receive an axially adjustable register pin assembly, generally at in accordance with the present invention. It will be understood that the insertion bar 3 could have a suitable aperture instead of a recess 9 and that the register pin could be secured directly to the plate cylinder body 2.

Figure 2:
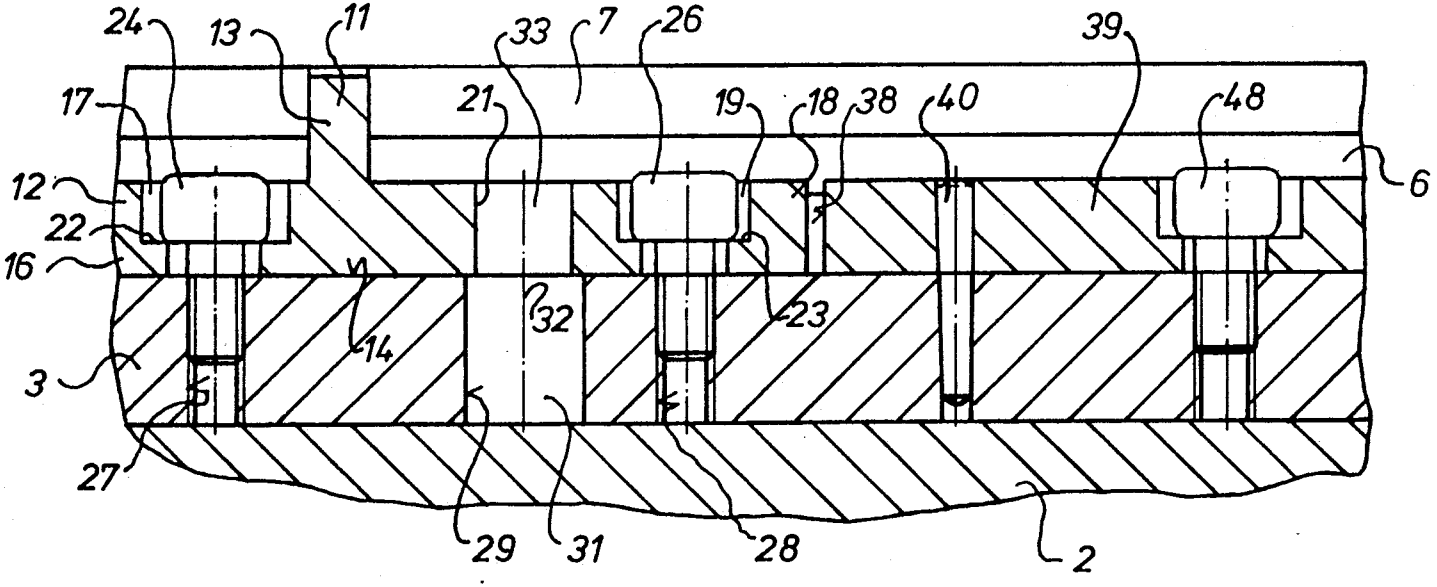
FIG. 2 is cross-sectional view of the register pin assembly positioned in the cylinder gap and taken along the axial direction of the cylinder gap.

As may be seen most clearly in FIGS. 2 and 3, the register pin has an upper register portion 13 which engages the leading and trailing edges of a printing plate 7 as will be discussed in detail subsequently; and a lower fastening portion, generally at 12. The fastening portion 12 rests on the surface 14 of the insertion bar 3 and is slidable axially in the recess 9 in the insertion bar 3.

A first end 16 of the fastening portion 12 of the register pin 11 has a first elongated hole 17. As may be seen in FIGS. 2 and 3 this elongated hole 17 is generally ovoid with its long axis aligned with the axis of rotation of the plate cylinder 2 and with the cylinder gap 1. A second end 18 of the fastening portion 12 of the register pin 11 has a second, similar elongated hole 19. These two spaced, elongated holes 18 and 19 are used to secure the fastening portion 12 of the register pin 11 to the surface 14 of the insertion bar 3. Each of these spaced, elongated fastening holes 17 and 19 has a shoulder 22 and 23, respectively which is engageable with the head of a fastening screw 24 or 26, respectively. As may be seen most clearly in FIG. 3 these shoulders 22 and 23 are shaped generally concentrically with the elongated holes 17 and 19 but are smaller in size. Each elongated hole 17 and 19 and its respective shoulder 22 and 23 overlies a tapped hole 27 or 28 in the insertion bar 3. A threaded fastening screw 24 or 26 is passed through the elongated hole 17 or 19 and as received in the underlying tapped hole 27 or 28. When these fastening screws 24 and 26 are backed off, typically by use of an allen wrench that is receivable in a hexagonal hole in the head of the screws, the register pin can be slid axially in the recess 9 in the insertion bar 3.

A third elongated hole 21 is formed in one of the two ends 18 or 22 of the fastening portion 12 of the register pin. In the depicted embodiment, this elongated adjusting hole 21 is formed in the second end 18 but between the spaced elongated fastening holes 17 and 19. As may be seen in FIG. 3, the elongated adjusting hole 21 is also generally ovoid. However, its major axis is aligned generally in the direction of rotation of the plate cylinder 2 and is thus generally 90° to the long axis of the elongated fastening holes 17 and 19.

A threaded bore hole 29 is formed in the insertion bar 3 and underlies the elongated adjusting hole 21. This bore hole 29 receives the threaded shank of an adjusting bolt 31. An upper journal portion 33 of the adjusting bolt is eccentric with respect to the axis of rotation 32 of the shank of the adjusting bolt 31. This eccentric journal portion 33 of the adjusting bolt 31 is positioned in the elongated adjusting slot 21. The eccentric journal 33 has a hexagonal hole 34 which is accessible from above, in a manner similar to the hexagonal holes in the heads of the two fastening screws 24 and 26. The same tool can be used to rotate all three.

Figure 3:
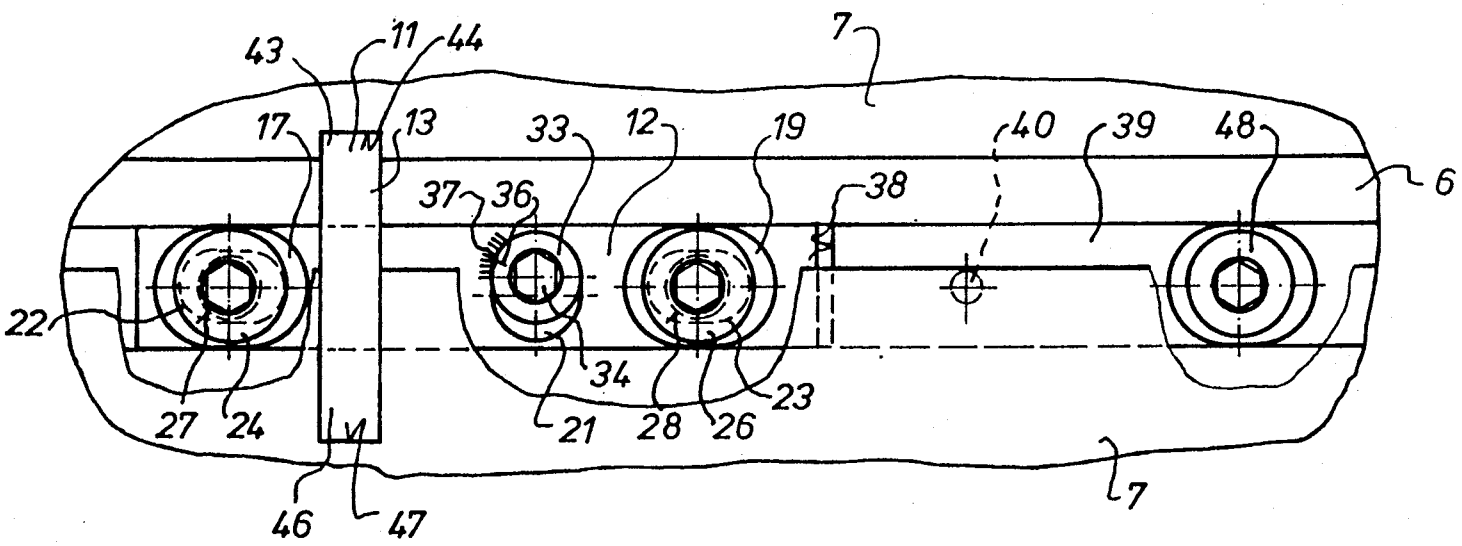
FIG. 3 is a top plan view of the axially adjustable register pin assembly in accordance with the present invention.

The eccentric head or journal 33 of the adjusting bolt 31 has a reference mark 36, as may be seen in FIG. 3. This mark 36 cooperates with a scale 37 that is formed on the top of the second end 18 of the fastening portion 12 of the register pin adjacent the adjusting hole 21. When it is desired to axially shift the register pin 11 in its recess 9 in the insertion bar 3, the two fastening screws 17 and 19 are backed off or loosened using a suitable tool. The same tool can then be inserted into the hexagonal hole 34 in the adjusting bolt 31 and turned to rotate the bolt. This rotation will cause the eccentric journal 33 of the adjusting bolt 31 to shift in the elongated adjusting slot 21 so that the register pin 11 will shift axially in its recess 9. Once the register pin 11 has been shifted axially to the desired position, the fastening screws 24 and 26 may be tightened.

The adjusting scale 37 and the adjusting mark 36 may be used to measure the amount of movement of the register pin 11. Alternatively, a gauge can be inserted between an end, such as the second end 18 of the fastening portion 12 of the register pin 11 and a reference side or end 38 of a stop element 39 that is also secured in the recess 9 of the insertion bar 3, as may be seen in FIGS. 2 and 3. The stop element 39 is held in place in the recess 9 by a taper pin 40 and a securement or fastening screw 48 that passes through the stop element 39 and is received in a threaded hole in the insertion bar 3.

Referring again to Fig 1, it will be seen that the register portion 13 of the register pin 11 is generally in the shape of an upright T with the horizontal upper part or bar of the T extending generally in the direction of rotation of the plate cylinder 2. The transitions between the horizontal upper bar 41 and the vertical leg 42 of the T-shaped register portion 26 of the register pin are generally rounded or arcuate and are shaped to engage the surfaces of the rotatable parts of the plate fixing and clamping devices 4 and 6.

A right upper register end 43 of the register portion 13 of the register pin is received in a register slot 44 on the leading edge of the printing plate, as may be seen in Figs 1 and 3. Similarly, a left upper register end 46 of the register portion 13 is received in a register slot 47 on the trailing or following edge of the printing plate 7.

While a preferred embodiment of an axially adjustable register pin assembly in accordance with the present invention has been set forth fully and completely hereinabove, it will be apparent to one of skill in the art that various changes in, for example, the size of the plate cylinder, the length of the cylinder gap, the type of plate end clamping devices and the like can be made without departing from the true spirit and scope of the present invention which is accordingly to be limited only by the following claims.

WHAT IS CLAIMED IS:

1. An axially adjustable register pin assembly which is useable to axially shift and align a printing plate having register slots on its leading and trailing ends on a plate cylinder, said axially adjustable register pin assembly comprising:

an insertion bar positionable in a cylinder gap which extends axially along a peripheral surface of a plate cylinder;

a register pin slidably securable on said insertion bar, said register pin having an upper register portion and a lower fastening portion;

at least a first fastening means positioned in a first elongated fastening slot in said fastening portion of said register pin, said first elongated fastening slot having a first axis of elongation;

An elongated adjusting slot in said fastening portion of said register pin, said elongated adjusting slot having a second axis of elongation that is generally arranged at 90° to said first axis of elongation; and adjusting means in said adjusting slot operable to move said register pin axially in said insertion bar.

2. The axially adjustable register pin assembly of claim 1 wherein said adjusting means is an adjusting bolt having a threaded shank rotatably received in a borehole in said insertion bar and an eccentric journal that engages said adjusting slot.

3. The axially adjustable register pin assembly of claim 1 wherein said at least first fastening means is a fastening screw having a head and a threaded shank and further wherein said at least first elongated fastening slot has a first elongated shoulder, said fastening screw head engaging said shoulder and said fastening screw threaded shank being received in a threaded fastening receiving borehole in said insertion bar.

* * * * *